US005429568A

United States Patent [19]

Chen

[11] Patent Number: 5,429,568

[45] Date of Patent: Jul. 4, 1995

[54] HORSE-RIDING TYPE EXERCISER

[76] Inventor: Paul Chen, No. 3-6, Ching Yang Rd., Liu Pao Village, Ta Ya Hsiang, Taichung Hsien, Taiwan

[21] Appl. No.: 272,767

[22] Filed: Jul. 8, 1994

[51] Int. Cl.[6] ..... A63B 69/06; A63B 21/068

[52] U.S. Cl. ..... 482/96; 482/57; 482/72

[58] Field of Search ..... 482/51, 57, 72, 95, 482/96, 111, 148; 472/106, 110

[56] References Cited

U.S. PATENT DOCUMENTS

| | | | |
|---|---|---|---|
| 5,156,650 | 10/1992 | Bals | 482/57 |
| 5,299,997 | 4/1994 | Chen | 482/96 |
| 5,356,357 | 10/1994 | Wang et al. | 482/96 |
| 5,356,358 | 10/1994 | Chen | 482/57 |
| 5,366,428 | 11/1994 | Liao | 482/96 |
| 5,370,594 | 12/1994 | Grinblat | 482/72 |

*Primary Examiner*—Stephen R. Crow
*Attorney, Agent, or Firm*—Woodcock, Washburn, Kurtz, Mackiewicz & Norris

[57] ABSTRACT

A horse-riding type exerciser includes a base frame, an axle being rotatably mounted to the base frame between a pair of parallel elongated beams of which each has a track, a pair of supporting rods respectively pivotally engaged with the elongated beams, a stop device abutting beside each of the supporting rods such that the supporting rods are restricted to move between a first position where the first end of the base frame is lifted to a higher level than that of the second end thereof, and a second position where the first and second ends of the base frame are at an equal level, a foot post device pivotally mounted to the axle, a seat post device securely mounted to the axle to pivot therewith. A drive post device pivotally engaged with the seat post device, a rod being mounted to a lower end of the drive post device, a roller being rotatably mounted to each of the free ends of the rods and being movably received in associated the track in each of the elongated beams, a connecting beam pivotally engaged with the drive post device and pivotally engaged with the foot post device.

6 Claims, 5 Drawing Sheets

HORSE-RIDING TYPE EXERCISER

BACKGROUND OF THE INVENTION

1. Field of Invention

The present invention relates to a horse-riding type exerciser.

2. RELATED PRIOR ART

The closest prior art of a horse-riding type exerciser is disclosed in the Applicant's own U.S. Pat. No. 5,299,997, filed Aug. 24, 1993. However, such an arrangement is not able to produce a varying resistance to a user. In addition, the exerciser is not able to perform a variety of functions in a simple fashion.

The present invention has arisen to mitigate and/or obviate the above-mentioned disadvantages of the conventional exerciser.

SUMMARY OF THE INVENTION

The primary objective of the present invention is to provide a horse-riding type exerciser which is able to produce a varying resistance to the user.

Another objective is to provide a horse-riding type exerciser which is able to perform a variety of functions in a simple fashion.

In accordance with one aspect of the present invention, there is provided a horse-riding type exerciser comprising a base frame having first and second ends and including a pair of parallel elongated beams, an axle being rotatably mounted to the first end of the base frame between the pair of parallel elongated beams, each of the elongated beams having a track adjacent to the second end of the base frame, a pair of supporting rods mounted to the first end of the base frame and respectively pivotally engaged with the elongated beams, a stop means abutting beside each of the supporting rods such that the supporting rods are restricted to move between a first position where the first end of the base frame is lifted to a higher level than that of the second end thereof, and a second position where the first and second ends of the base frame are at an equal level. A foot post means has a lower end pivotally mounted to the axle and having an upper end, a pair of foot rests being mounted to the foot post means. A seat post means has a lower end securely mounted to the axle to pivot therewith and has an upper end, a seat being securely mounted on the upper end of the seat post means. A drive post means has an upper portion, a mediate portion and a lower portion, the mediate portion having an underside and an upper side pivotally engaged with the upper end of the seat post means to allow pivotal engagement between the drive post means and the seat post means, a pair of handgrips being mounted on the upper end of the drive post means, a rod being mounted to the lower end of the drive post means and having two free ends, a roller being respectively rotatably mounted to each of the free ends and being respectively movably received in associated the track in each of the elongated beams. A connecting beam has a first end pivotally engaged with the underside of the mediate portion of the drive post means and a second end pivotally engaged with the foot post means.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
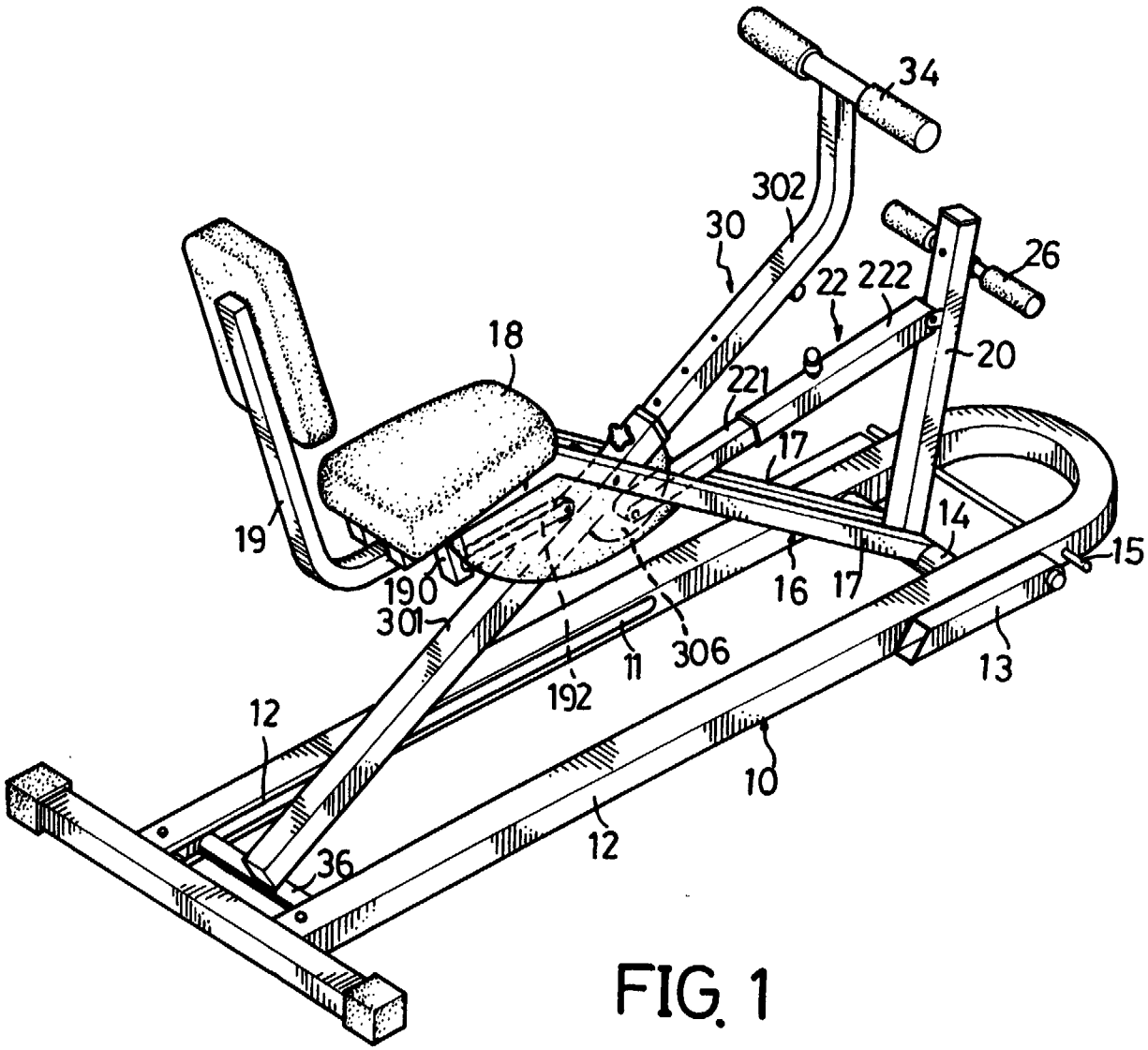
FIG. 1 is a perspective view of a horse-riding type exerciser in accordance with a first embodiment of the present invention.

Referring to the drawings, and particularly to FIG. 1, a horse-riding type exerciser in accordance with a first embodiment of the present invention comprises a base frame 10 having a pair of parallel elongated beams 12, an axle 14 being rotatably mounted to a first end of the base frame 10 between the pair of parallel elongated beams 12, each of the elongated beams 12 having a track 11 adjacent to the second end of the base frame 10. A foot post means 20 has a lower end pivotally mounted to the axle 14, a pair of foot rests 26 being mounted to the foot post means 20. A seat post means 16 has a lower end securely mounted to the axle 14 to pivot therewith, a seat 18 being securely mounted on an upper end of the seat post means 16. Preferably, the seat post means 16 includes two members 17 each with a lower end securely attached to the axle 14 to pivot therewith, the upper ends of the two members 17 are substantially horizontal for mounting the seat 18 thereon.

Figure 3:
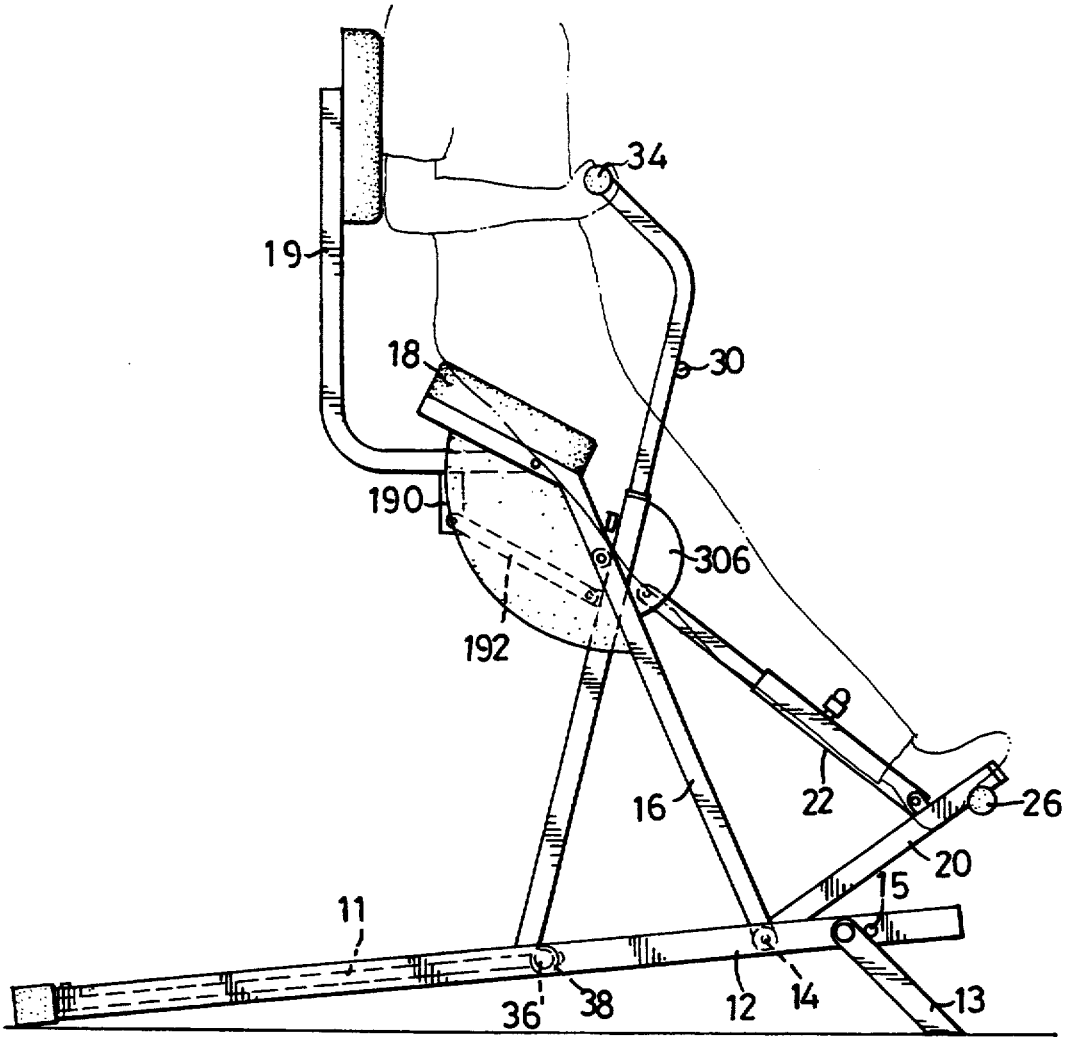

A drive post means 30 has an upper portion 302, a mediate portion and a lower portion 301, the mediate portion having an upper side pivotally engaged with the upper ends of the two members 17 of the seat post means 16 to allow relative pivotal movement between the drive post means 30 and the seat post means 16. A pair of handgrips 34 are mounted on the upper end 302 of the drive post means 30, the upper portion 302 of the drive post means 30 is adjustably received in the lower portion 301 of the drive post means 30 such that a user is able to practice the skill of pulling the handgrips 34 (see FIG. 3). A rod 36 is mounted to the lower end 301 of the drive post means 30, a roller 38 being rotatably mounted to each of the free ends of the rod 36 and being movably received in associated the track 11 in each of the elongated beams 12, a connecting beam 22 having a first end 221 pivotally engaged with the underside of the mediate portion of the drive post means 30 and a second end 222 pivotally engaged with the foot post means 20. Preferably, a pair of semi-circular plates 306 are securely mounted to the underside of the mediate portion of the drive post means 30, the first end 221 of the connecting beam 22 being pivotally engaged between the pair of the semi-circular plates 306. The above-mentioned structure and operation are conventional and thus are not further described.

Figure 2:
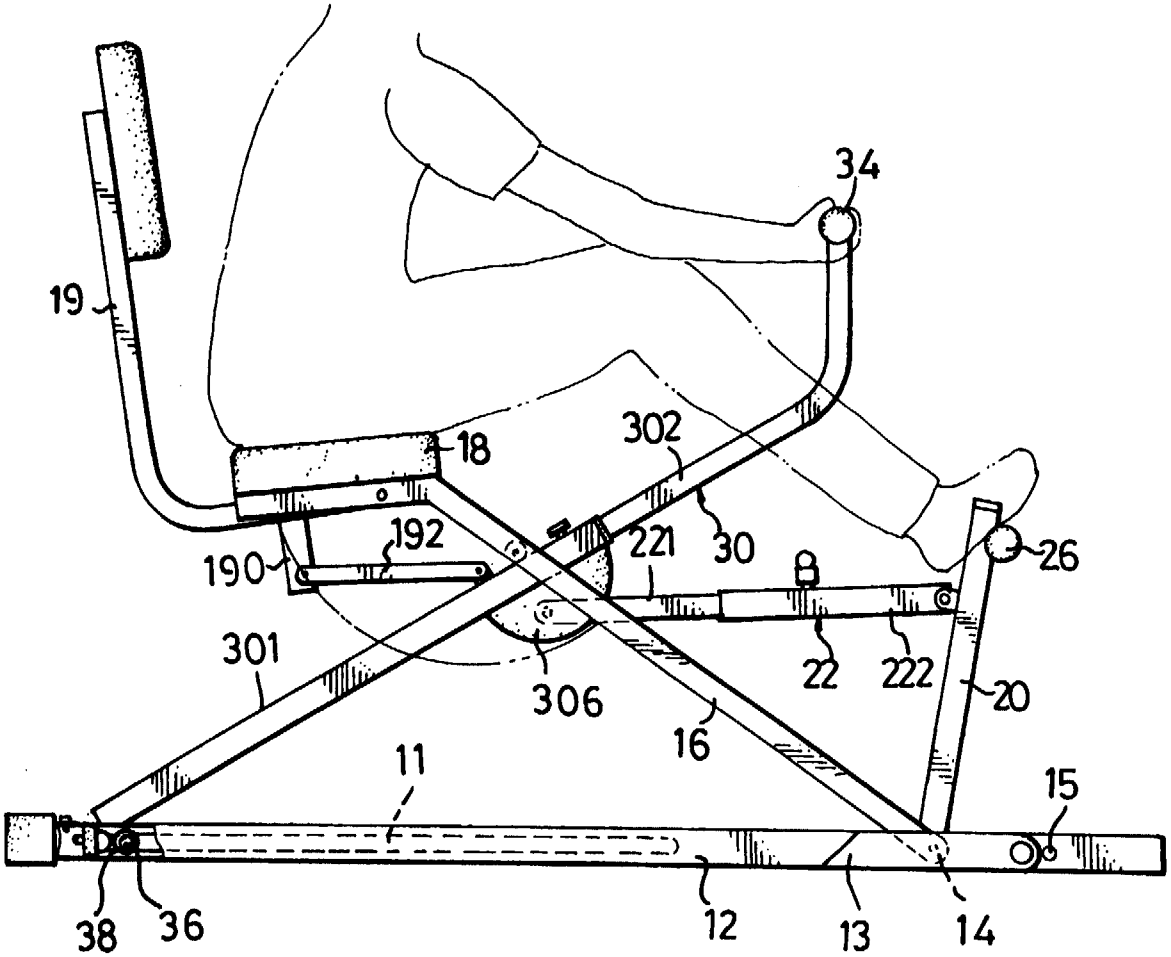
FIGS. 2 and 3 are schematic side views as shown in FIG. 1 illustrating operation of the horse-riding type exerciser.

Referring to FIG. 2, an L-shaped supporting member 19 has a substantially horizontal distal end pivotally engaged with the upper end of the seat post means 16 beneath the seat 18, a post 190 fixed to an underside of the horizontal distal end of the supporting member 19 to rotate therewith, a connecting member 192 having a first end pivotally engaged with the post 190 and a second end pivotally engaged with the upperside of the mediate portion of the drive post means 30. Preferably, the first end 221 of the connecting beam 22 is adjustably received in the second end 222 thereof such that the exerciser is suitable for users of different feet lengths.

Additionally, a pair of supporting rods 13 are laterally mounted to the first end of the base frame 10 and respectively pivotally engage with the elongated beams 12, a stop means having two bars 15 respectively abutting beside each of the supporting rods 13 such that the supporting rods 13 are restricted to move between a first position where the first end of the base frame 10 is lifted to a higher level than that of the second end thereof such that the center of gravity of the exerciser is redefined rearwards, and a second position where the first and second ends of the base frame 10 are at an equal level. By such an arrangement, due to the change of the center of gravity of the exerciser, the user is required to exert more force on the handgrips 34 to pull the handgrips 34 when the supporting rods 13 are in the first position than when the supporting rods 13 are in the second position so as to provide a varying resistance to the user (see FIG. 3).

Figure 4:
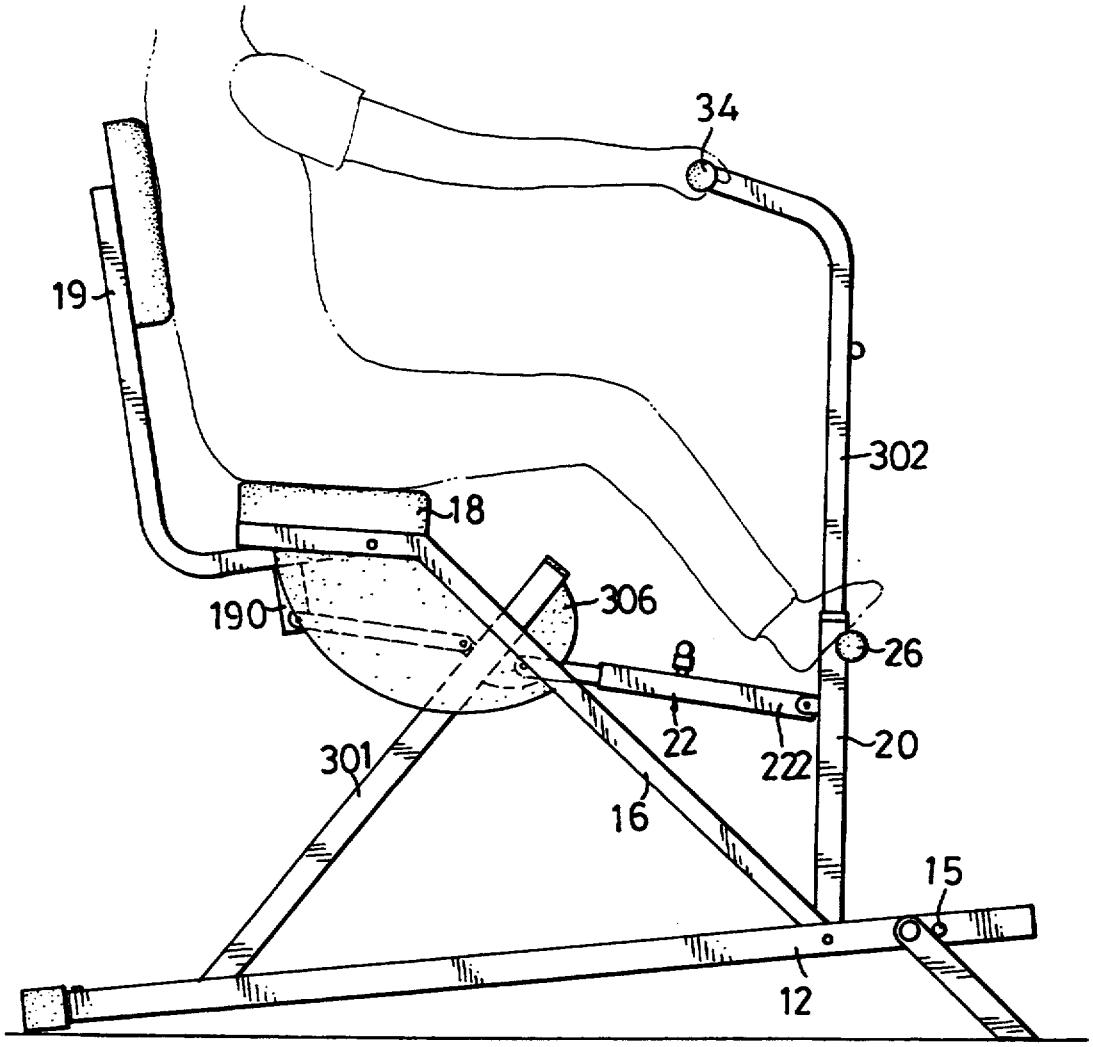
FIG. 4 is a schematic side view of the horse-riding type exerciser in accordance with a second embodiment of the present invention illustrating a user is practicing the skill of pushing the handgrips.
Figure 5:
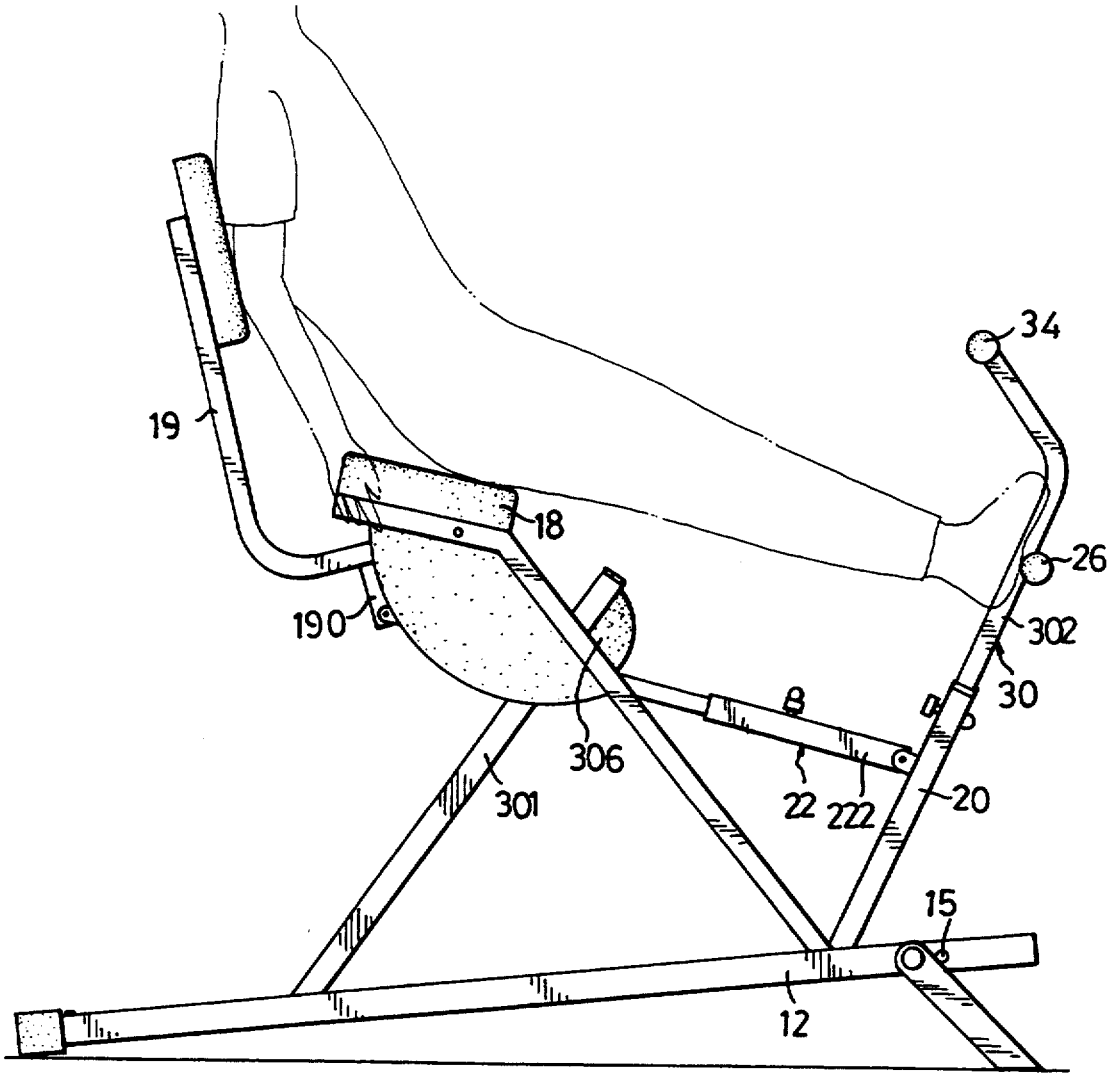
FIG. 5 is a schematic side view of the horse-riding type exerciser illustrating the user is exercising his legs.

Referring to FIG. 4, in accordance with a second embodiment of the present invention, the upper portion 302 of the drive post means 30 is adjustably received in the upper end of the foot post means 20 such that the user is able to practice the skill of pushing the handgrips 34. Additionally, the adjustability of the height of the upper portion 302 of the drive post means 30 results in that the exerciser is suitable for users of different heights. Alternatively, the pair of foot rests 26 are mounted to the upper portion 302 of the drive post means 30 when the upper portion 302 of the drive post means 30 is adjustably received in the upper end of the foot post means 20 such that the user is able to exercise his legs by pushing the foot rests 26 at different heights (see FIG. 5).

Accordingly, by such an arrangement, an exerciser in accordance with the present invention has the following advantages and benefits:

(1) The exerciser is able to produce a varying resistance to the user.

(2) The exerciser is able to perform a variety of functions in a simple fashion.

It should be clear to those skilled in the art that further embodiments of the present invention may be made without departing from the teachings of the present invention.

I claim:

1. A horse-riding type exerciser comprising:

a base frame (10) having first and second ends and including a pair of parallel elongated beams (12), an axle (14) being rotatably mounted to the first end of said base frame (10) between said pair of parallel elongated beams (12), each of said elongated beams (12) having a track (11) adjacent to the second end of said base frame (10), a pair of supporting rods (13) mounted to the first end of said base frame (10) and pivotally engaged with said elongated beams (12), a stop means (15) abutting beside each of said supporting rods (13) such that said supporting rods (13) are restricted to move between a first position where the first end of said base frame (10) is lifted to a higher level than that of the second end thereof, and a second position where the first and second ends of said base frame (10) are at an equal level;

a foot post means (20) having a lower end pivotally mounted to said axle (14) and having an upper end, a pair of foot rests (26) being mounted to said foot post means (20);

a seat post means (16) having a lower end securely mounted to said axle (14) to pivot therewith and having an upper end, a seat (18) being securely mounted on the upper end of said seat post means (16);

a drive post means (30) having an upper portion (302), a mediate portion and a lower portion (301), said mediate portion having an underside and an upper side pivotally engaged with the upper end of said seat post means (16) to allow pivotal engagement between said drive post means (30) and said seat post means (16), a pair of handgrips (34) being mounted on the upper end (302) of said drive post means (30), a rod (36) being mounted to the lower end (301) of said drive post means (30) and having two free ends, a roller (38) being rotatably mounted to each of said free ends and being movably received in associated said track (11) in each of said elongated beams (12); and a connecting beam (22) having a first end (221) pivotally engaged with the underside of said mediate portion of said drive post means (30) and a second end (222) pivotally engaged with said foot post means (20).

2. The horse-riding type exerciser in accordance with claim 1, wherein said first end (221) of said connecting beam (22) is adjustably received in said second end (222) thereof.

3. The horse-riding type exerciser in accordance with claim 1, wherein said upper portion (302) of said drive post means (30) is capable of moving between a first position where said upper portion (302) is adjustably received in said lower portion (301) of said drive post means (30), and a second position where said upper portion (302) is adjustably received in the upper end of said foot post means (20).

4. The horse-riding type exerciser in accordance with claim 3, wherein said pair of foot rests (26) are capable of being mounted to said upper portion (302) of said drive post means (30) when said upper portion (302) thereof is in the second position.

5. The horse-riding type exerciser in accordance with claim 1, further comprising an L-shaped supporting member (19) having a distal end pivotally engaged with the upper end of said seat post means (16) beneath said seat (18), a post (190) fixed to an underside of the distal end of said supporting member (19) to rotate therewith, a connecting member (192) having a first end pivotally engaged with said post (190) and a second end pivotally engaged with the upperside of said mediate portion of said drive post means (30).

6. The horse-riding type exerciser in accordance with claim 1, further comprising a pair of semi-circular plates (306) securely mounted to the underside of said mediate portion of said drive post means (30), the first end (221) of said connecting beam (22) being pivotally engaged between the pair of said semi-circular plates (306).

* * * * *